US005169045A

United States Patent [19]

Liu

[11] Patent Number: 5,169,045

[45] Date of Patent: Dec. 8, 1992

[54] MANUALLY-OPERATED TILE CUTTER

[76] Inventor: Wun-Hui Liu, No. 2, Jiann Guon Lane, Jiunn Guon Li, Taichung, Taiwan

[21] Appl. No.: 814,636

[22] Filed: Dec. 30, 1991

[51] Int. Cl.[5] ..... B28D 1/24

[52] U.S. Cl. ..... 225/96.5; 83/468; 83/886; 83/468.2; 125/23.02

[58] Field of Search ..... 225/96.5, 104; 125/23.01, 23.02; 83/467.1, 468, 468.1, 468.2, 468.4, 468.7, 886

[56] References Cited

U.S. PATENT DOCUMENTS

| | | | |
|---|---|---|---|
| 2,568,816 | 9/1951 | Marus | 125/23.02 |
| 2,745,447 | 5/1956 | Studley, Jr. | 83/468 X |
| 4,693,232 | 9/1987 | Yasuga | 225/96.5 X |
| 5,040,445 | 8/1991 | Liou | 225/96.5 X |

FOREIGN PATENT DOCUMENTS

| | | | |
|---|---|---|---|
| 0212244 | 1/1958 | Australia | 125/23.02 |
| 0318466 | 1/1920 | Fed. Rep. of Germany | 125/23.02 |
| 2716085 | 10/1978 | Fed. Rep. of Germany | 125/23.02 |

*Primary Examiner*—Frank T. Yost
*Assistant Examiner*—Raymond D. Woods
*Attorney, Agent, or Firm*—Browdy and Neimark

[57] ABSTRACT

A manually-operated tile cutter comprises mainly a base, a measuring piece, and a guiding bar. The base is provided at one end thereof with a stopper consisting of a stopper face perpendicular to the cutting direction and of a guide slot parallel to the stopper face. The measuring piece is composed of a length measuring portion and an angle measuring portion disposed at one end of the length measuring portion. The length measuring portoin is disposed slidably in the guide slot. The guiding bar is pivotally arranged on the angle measuring portion so as to point out on the angle measuring portion the angle formed by the guiding bar and the length measuring portion. The cutter therefore guides and holds the tile intended to be cut in a vertical manner. The guiding bar can be also used to point out the angle and to support the tile when the cutter is doing an angular cutting of the tile.

2 Claims, 4 Drawing Sheets

MANUALLY-OPERATED TILE CUTTER

BACKGROUND OF THE INVENTION

The present invention relates to a tile cutting or scoring tool, and more particularly to an improved manually-operated tile cutter.

The manually-operated tile cutter of the prior art is provided with a padded board comprising at one end of a longitudinal axis thereof a stopper which can be rotated for a predetermined angle and then fixed. The stopper consists of a stopper face having a length scale thereon. In addition, the base of the cutter is provided with an angle scale located at the position relative to the place where the stopper rotates so as to enable the cutter to execute the scoring of the tile at any angle. However, such tile cutter of prior art is defective in design in that it is provided with the stopper face serving to guide only the top side of the tile to be cut in a vertical manner and is not provided with means to guide and hold both left and right sides of the tile intended to be cut in a vertical manner. As a result, the scoring position of the tile is subjected to a deflection error when the length of the tile to be cut is aligned with the length scale of the stopper face. Furthermore, such tile cutter of the prior art is designed in such a way that it requires a cutter to measure individually the length of the tiles having identical dimension.

It must be pointed out here that the tile cutter of prior art is provided with the angle scale which is disposed on the cutter base. As a result, the surface area of the base must be increased accordingly, resulting in a substantial increase in the volume of the cutter as well as the cost of making such tile cutter.

SUMMARY OF THE INVENTION

It is therefore the primary objective of the present invention to provide a manually-operated tile cutter with a vertical guiding means to facilitate the scoring of the tile in a vertical manner without a deflection error.

It is another objective of the present invention to provide a manually-operated tile cutter with an angle scale, which is disposed on a measuring piece having a length scale thereon. As a result, the cutter base is devoid of an angle scale.

It is still another objective of the present invention to provide a manually-operated tile cutter with means capable of guiding the scoring angle and holding the tile intended to be cut at the same time.

In keeping with the principles of the present invention, the foregoing objectives of the present invention are accomplished by a manually-operated tile cutter, which comprises a base, a rigid protruded strip disposed on the surface of the base, an elastic loading surface disposed respectively on each of both sides of the protruded strip, two guide rods mounted on the base in such manner that they are parallel to the protruded strip, a drawing platform mounted slidably on the guide rods, a cutter mounted pivotally to the drawing platform, an operating lever fastened securely to the the upper end of the cutter, a rotary knife mounted pivotally on the lower end of the cutter, and a press piece attached securely to the portion of the cutter just behind the rotary knife. The manually-operated tile cutter of the present invention is characterized in that it further comprises an elongated stopper, a measuring piece, and a guiding and holding rod. The stopper is disposed at one end of the surface of a base and is normal to the protruded strip. The stopper is provided with a stopper face positioned slightly higher than the elastic loading surface and with a guide slot perpendicular to the protruded strip. The measuring piece is composed of a length measuring portion disposed slidably on the guide slot and of an angle measuring portion. The length scale is marked along the longitudinal axis of the length measuring portion, while the angle scale is marked on the angle measuring portion, with the extension line of the zero degree position being parallel to the longitudinal axis of the length measuring portion. The guiding bar is pivotally arranged on the curvature center of a bowlike curved path formed by the angle scale of the angle measuring portion. As a result, the guiding bar forms, in conjunction with the stopper face, a vertical guiding and holding portion when the guiding bar is positioned perpendicularly to the length measuring portion so as to guide and hold the tile to be cut vertically. As the length measuring portion is capable of sliding on the guide slot, the vertical guiding and holding portion can be moved to an appropriate position in accordance with the desired length of the cut of the tile. But a pointer can be set up at the center of the guide slot for the purpose of pointing out the length scale of the length measuring portion. The guiding and holding rod is provided at one end thereof with a pointer for pointing out the angle scale of the angle measuring portion. Therefore, the guiding and holding rod can be rotated to allow its pointer to aim at the position of a desired scoring angle to execute the scoring of the tile. Of course, the guiding and holding rod may be provided with the length scale so that the measurements of both cutting angle and the length of the cut portion can be taken simultaneously.

The foregoing objectives and features will be better understood by studying the following detailed description of the preferred embodiment, in conjunction with the drawings provided herewith.

DETAILED DESCRIPTION OF THE PREFERRED EMBODIMENT

Figure 1:
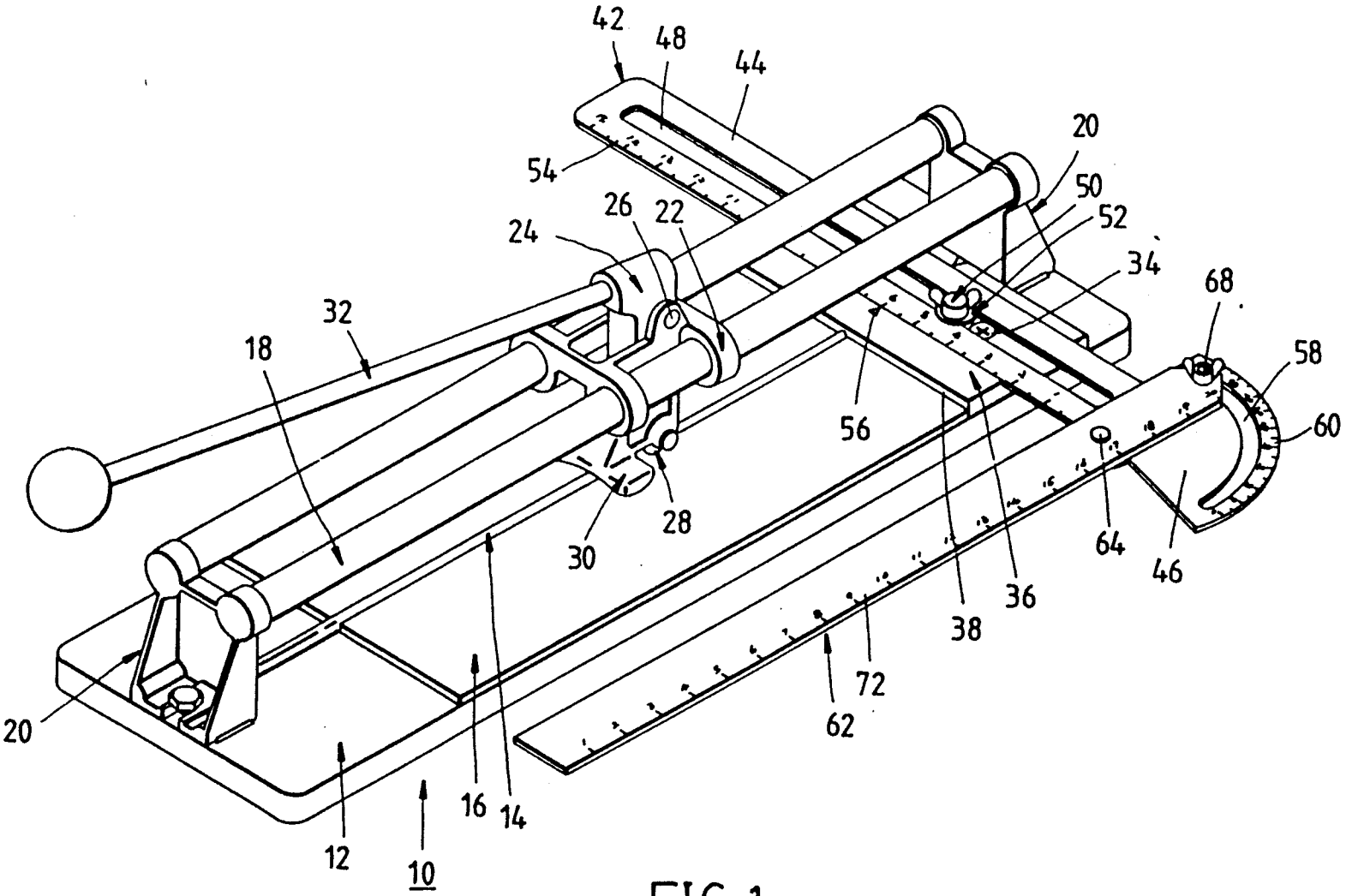
FIG. 1 shows a three-dimensional view of the preferred embodiment of the present invention.
Figure 2:
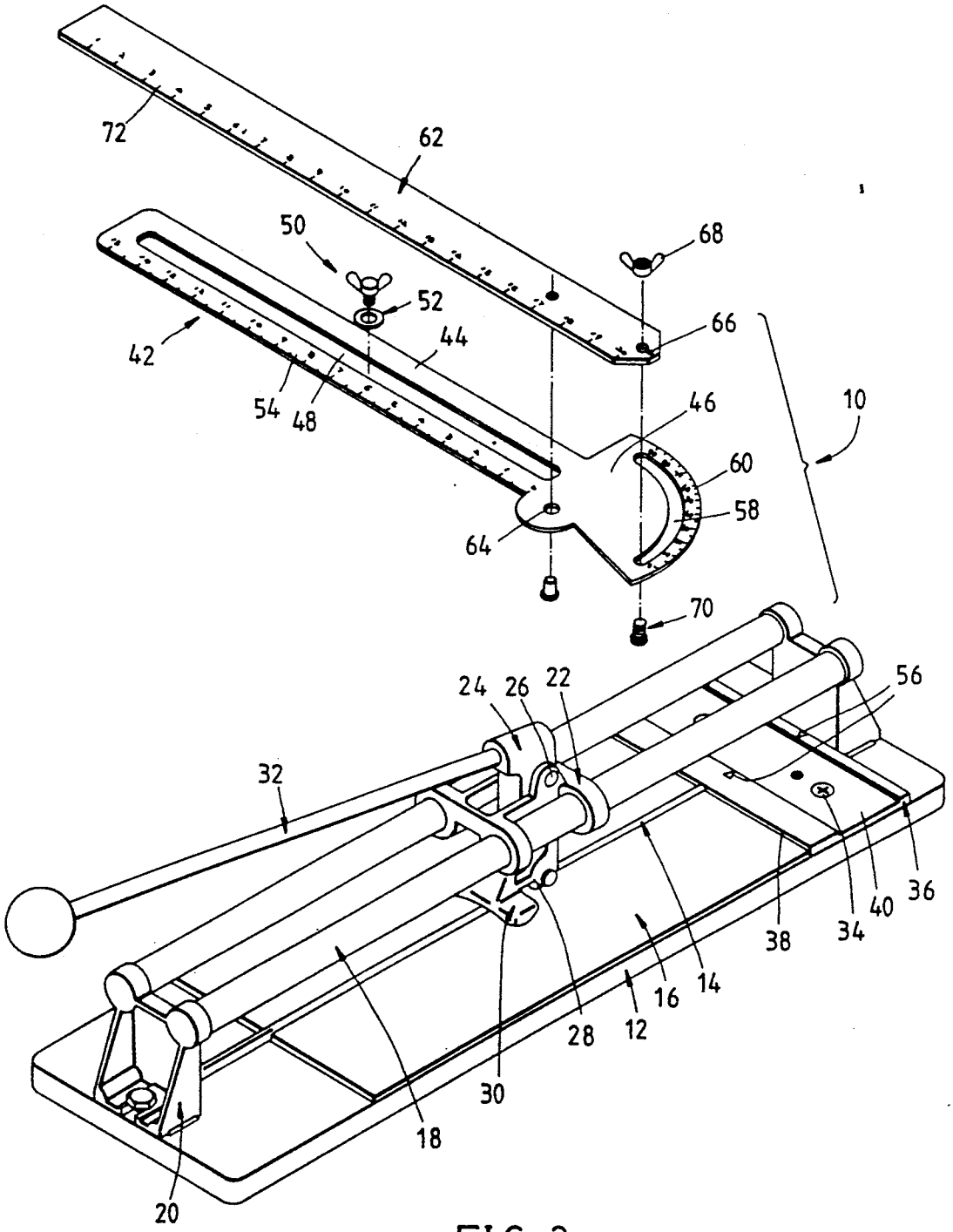
FIG. 2 shows an exploded view of the preferred embodiment of the present invention.
Figure 3:
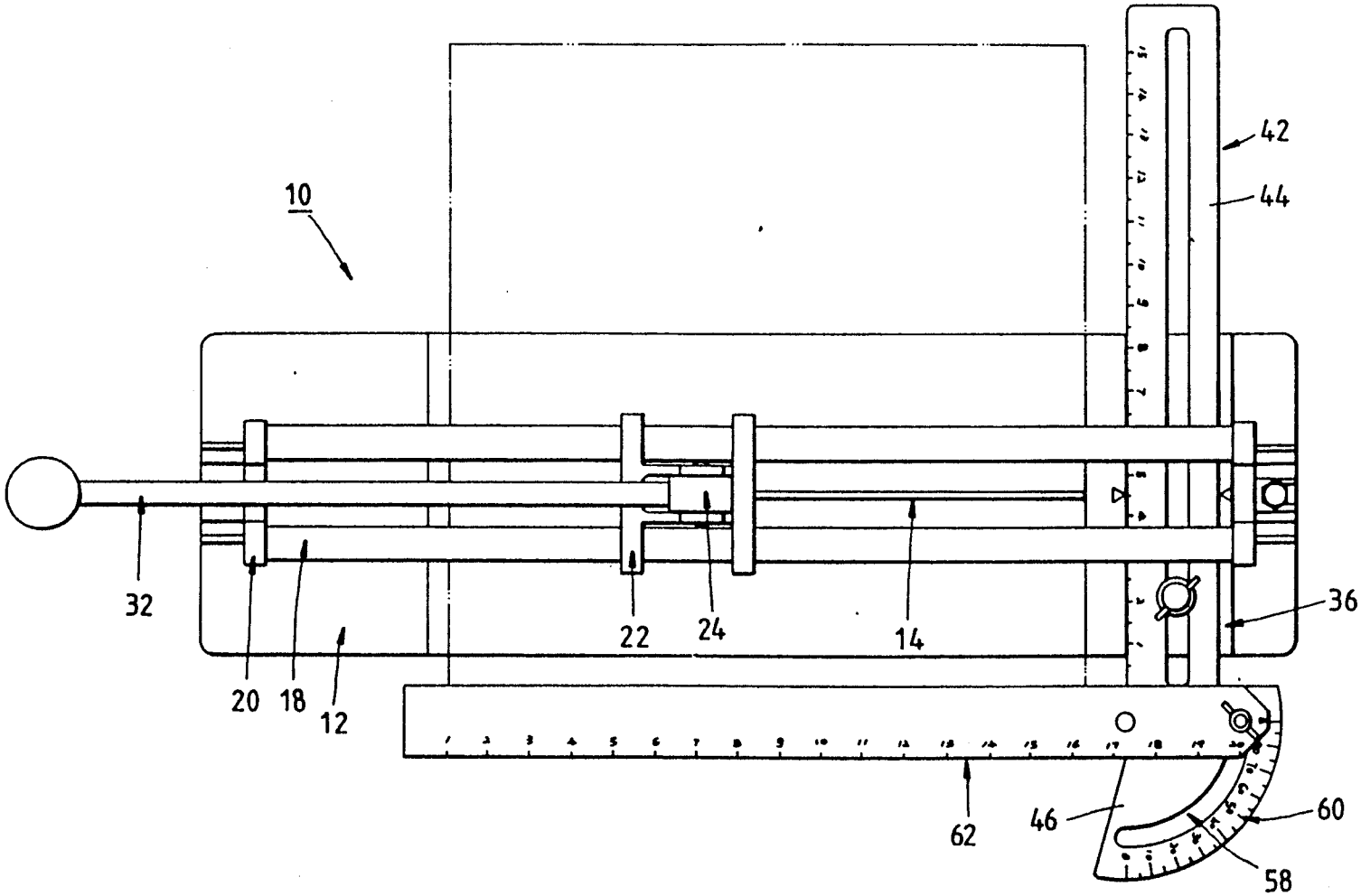
FIG. 3 is a top view of the preferred embodiment of the present invention doing a vertical score.
Figure 4:
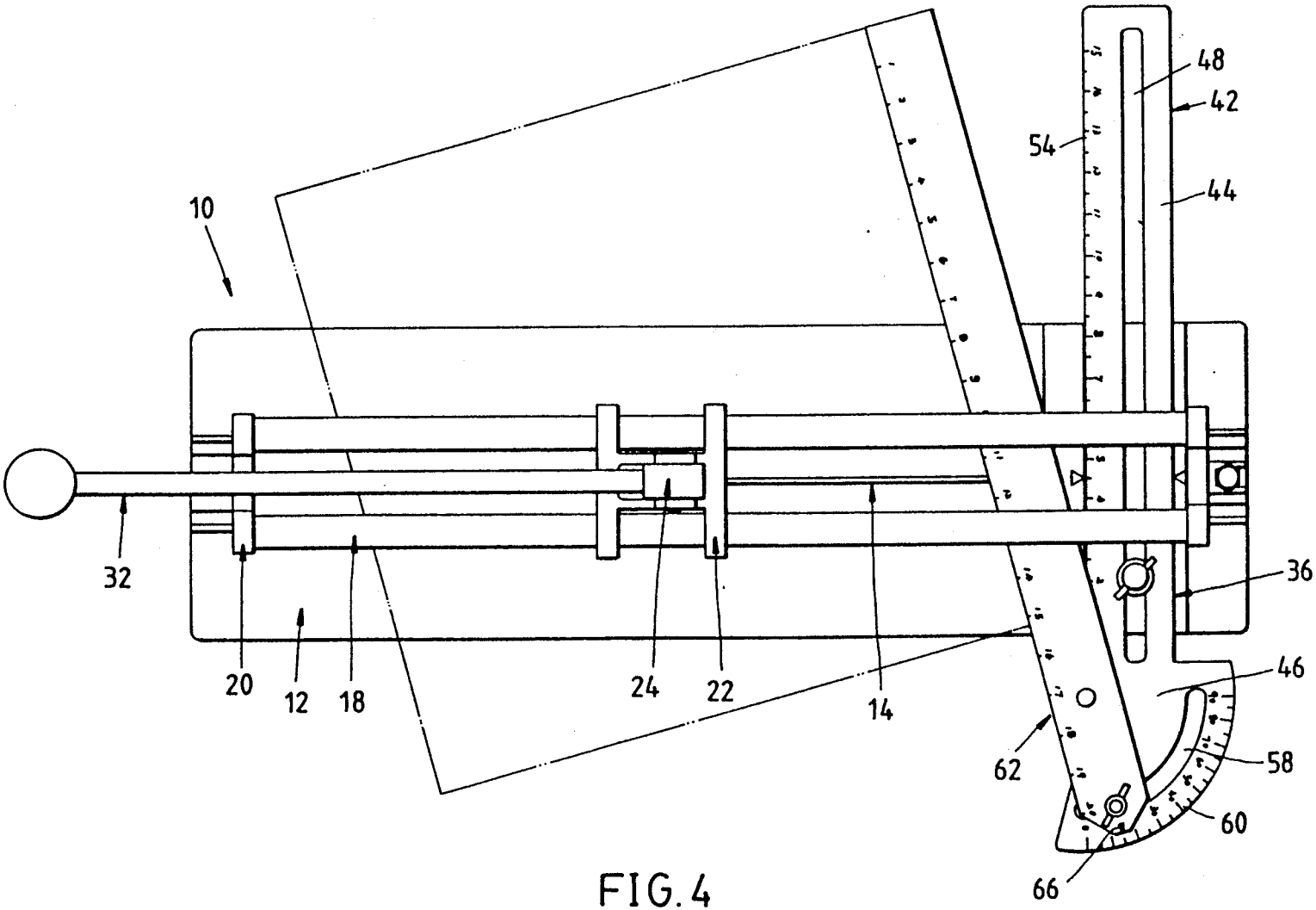
FIG. 4 shows a top view of the preferred embodiment of the present invention doing an angular score.

Referring to all drawings provided herewith, the manually-operated tile cutter 10 of the present invention is shown comprising a rectangular base 12 with a rigid protruded strip 14 disposed at the center along the longitudinal axis thereof. Located at both sides of the protruded strip 14 are elastic loading surfaces 16 made of rubber. Two parallel guide rods 18 are disposed above the protruded strip 14 and are supported at both ends thereof by braces 20. A drawing platform 22 is fitted over each of the guide rods 18. A scoring device 24 is pivotally attached to the drawing platform 22 by means of a lock pin 26, while a rotary knife 28 is pivotally fastened to the front side of the bottom of the scoring device 24. The press piece 30 is fastened securely to the rear side of the bottom of the scoring device 24 in such a manner that it crosses both sides of the protruded strip 14. An operating lever 32 is coupled with the top end of the scoring device 24. In the process of scoring, the tile intended to be cut is placed on the loading surface 16, and then the operating lever 32 is lifted to cause the rotary knife 28 to press against the tile to be cut. Thereafter, the operating lever 32 is pulled to trigger the rotary knife 28, in conjunction with the surface of movement of the drawing platform 22, to make a scoring mark on the tile along the position consistent with the protruded strip 14. Finally, the operating lever 32 is pressed to permit the press piece 30 to constrain the tile to be cut, which will then be broken into two pieces along the scoring mark, with the protruded strip 14 acting like a fulcrum in the process.

The tile cutter 10 of the present invention is characterized in that it comprises an elongated stopper 36 fastened securely by means of two bolts 34 to one end of the longitudinal axis of the base 12, and that the stopper 36 is provided with a stopper face 38 which is higher than the loading surface 16 and is intended to give a support to the top side of the tile to be cut in a vertical manner, and further that its base 12 comprises a guide slot 40 perpendicular to the protruded strip 14.

The measuring piece 42 comprises a batten-like length measuring portion 44 and a sectoral angle measuring portion 46, which are made integrally into a unitary body. The length measuring portion 44 is received on the guide slot 40 and is composed of a long through groove 48 centrally located along the longitudinal axis thereof. A first positioning bolt 50 passes through the through groove 48 to engage the guide slot 40. A washer 52 is sandwiched between the positioning bolt 50 and the top surface of the length measuring portion 44 and has an outer diameter larger than the width of the through groove 48. The washer 52 is intended to help position securely the length measuring portion 44 by tightening the positioning bolt 50. When the positioning bolt 50 is loosened, the measuring piece 42 can be slid along the through groove 48. The length measuring portion 44 is provided with a length scale 54 along one of its sides adjacent to the stopper face 38. A pointer 56 is disposed at the edge of the guide slot 40 for guiding the length of the cut of the tile to be cut in a vertical manner.

Disposed in the angle measuring portion 46 is a bowlike curved groove 58, which is provided at the outer edge thereof an angle scale 60 having thereon graduations from zero to ninety degrees, with the extension line of the position at zero degree on the scale being parallel to the longitudinal axis of the length measuring portion 44. The guiding bar 62 is pivotally arranged on the curvature center 64 of a bowlike curved path formed by the angle scale 60. As a result, when the guiding bar 62 is rotated by using the curvature center 64 as a pivot, the pointer 66 at one end of the guiding bar 62 can be used to point out the angle formed by the longitudinal axes of the guiding bar 62 and the length measuring portion 44. The tile to be cut is then placed against the side of the guiding bar 62 to be ready for scoring in accordance with the desired angle pointed out by the pointer 66. A butterfly nut 68 passes through one end of the guiding bar 62 and the curved groove 58 to engage the bolt 70 so as to help position the guiding bar 62 at a specified angle. As the butterfly nut 68 is loosened, the guiding bar 62 can be rotated along the path consistent with the curved groove 58 so that the pointer 66 can point at the graduations on the angle scale 60. In addition, the guiding bar 62 can be provided at one side thereof with a length scale 72 so that the measurements of both cutting angle and the length of the cut portion can be taken simultaneously.

When the guiding bar 62 is positioned at 90 degree on the angle scale 60, it forms along with the stopper face 38 a vertical angle, in which the tile to be cut can be then positioned in a vertical manner to be ready for being cut, with both adjacent sides of the tile to be cut receiving support. Furthermore, the guiding bar 62 is coupled with the measuring piece 42. The vertical angle formed by the guiding bar 62 and the stopper face 38 can be moved along with the movement of the length measuring portion 44 in the guide slot 40 so as to facilitate the operation of cutting the tiles having different lengths. When an angular cutting is called for, the length measuring portion 44 can be first positioned on the guide slot 40, and then the guiding bar 62 is rotated to be positioned at a desired angle. Thereafter, the tile intended to be cut can be then placed against one side of the guiding bar 62 so that it can be cut in accordance with a desired angle.

What I claim is:

1. A manually-operated tile cutter comprising a base, a rigid protruded strip disposed on said base, an elastic loading surface disposed on both sides of said protruded strip, two guide rods mounted on said base in such a manner that they are parallel to said protruded strip, a drawing platform fitting slidably over each of said guide rods, a cutter with top end and bottom end arranged pivotally on said drawing platform, an operating lever fastened to said top end of said cutter, a rotary knife pivoted to said bottom end of said cutter, and a press piece attached to said cutter adjacent said rotary knife in such a manner that it crosses over said protruded strip, said tile cutter being characterized in that it further comprises:

(a) an elongated stopper disposed at one end of said base in such manner that its longitudinal axis is normal to said protruded strip and that it has a stopper face higher than said elastic loading surface, said stopper comprising a guide slot parallel to the longitudinal axis thereof;

(b) a measuring piece provided with a length measuring portion disposed slidably in said guide slot and with an angle measuring portion with angle scale disposed at one end of said angle measuring portion;

(c) a guiding bar pivoted to a curvature center of said angle scale of said angle measuring portion, said guiding bar having a length scale;

(d) said angle measuring portion and said length measuring portion being made integrally into a unitary body; and (e) wherein said angle measuring portion is composed of a bowlike curved slot having said angle scale on one side thereof, with an extension line of a zero degree position being parallel to the longitudinal axis of said length measuring portion;

(f) wherein said guiding bar is provided with a pointer; and (g) wherein said guiding bar is set in a fixed position by means of a first positioning bolt passing through said bowlike curved slot after a predetermined rotation of said pointer of said guiding bar around said curvature center.

2. A manually-operated tile cutter according to claim 1, wherein said length measuring portion of said measuring piece is provided with a through slot having a length scale on one side thereof and with a second positioning bolt passing through said through slot to engage said guide slot.

* * * * *